US006361482B1

(12) United States Patent
Batca et al.

(10) Patent No.: US 6,361,482 B1
(45) Date of Patent: Mar. 26, 2002

(54) LEG EXERCISE MACHINE

(76) Inventors: L. Ron Batca; Roger Batca, both of 3102 Shaftsbury St., Durham, NC (US) 27704

( * ) Notice: Subject to any disclaimer, the term of this patent is extended or adjusted under 35 U.S.C. 154(b) by 0 days.

(21) Appl. No.: 09/434,656

(22) Filed: Nov. 5, 1999

(51) Int. Cl.[7] ..... A63B 21/062; A63B 23/04

(52) U.S. Cl. ..... 482/100; 482/134; 482/137; 482/138; 482/142

(58) Field of Search ..... 482/79, 80, 133–139, 482/100, 142

(56) References Cited

U.S. PATENT DOCUMENTS

| | | | | | |
|---|---|---|---|---|---|
| 4,358,108 | A | * | 11/1982 | Voris | 272/118 |
| 4,448,412 | A | * | 5/1984 | Brentham | 272/130 |
| 4,746,115 | A | * | 5/1988 | Lahman | 272/130 |
| 4,776,587 | A | * | 10/1988 | Carlson et al. | 272/129 |
| 5,518,477 | A | * | 5/1996 | Simonson | 482/102 |
| 5,667,465 | A | * | 9/1997 | McCollum et al. | 482/100 |
| 5,733,233 | A | * | 3/1998 | Webber | 482/137 |
| 5,800,321 | A | * | 9/1998 | Webber | 482/103 |

OTHER PUBLICATIONS

Pamphlet entitled "M4 The Ultimate in Fitness Training" (4 pages).
Pamphlet entitled "Personal Trainer 2000" (2 pages).
Pamphlet entitled "Personal Trainer 2100" (2 pages).
Pamphlet entitled "Ultra Trainer 3000" (2 pages).
Pamphlet entitled "Ultra Trainer 3100"(2 pages).

* cited by examiner

*Primary Examiner*—J. Donnelly
*Assistant Examiner*—Victor Hwang
(74) *Attorney, Agent, or Firm*—Coates & Bennet, PLLC

(57) ABSTRACT

An exercise machine having a frame structure, a seat member supported by the frame structure, and a resistance device. A leg member is operatively connected to the resistance device and pivotally connected to the frame structure for engagement by a user's legs when positioned within the seat member. A knee alignment support is positioned adjacent to the seat support and under the user's legs when positioned within the seat member. The knee alignment support being selectively positionable between a first in position for performing a first exercise and a second out position for performing a second exercise.

16 Claims, 6 Drawing Sheets

LEG EXERCISE MACHINE

FIELD OF THE INVENTION

The present invention is directed to a leg exercise machine and, more particularly, to a leg exercise machine having an adjustable leg support for performing at least two separate exercises.

BACKGROUND OF THE INVENTION

Exercise machines are used by many persons for maintaining physical fitness and building muscle mass. Exercise machines are often designed to exercise a particular muscle group, and a user may work on four or five separate machines during the course of a workout to work the various muscles of the body. Each of these machines is often large in size and expensive. It is advantageous to combine multiple exercises within a single machine to reduce the amount of space required for exercising, and to lessen the cost of purchasing equipment.

Leg-exercising machines for performing both leg extensions and leg curls are known. To perform leg extension exercises, the user engages a leg exercise device while in a seated position. The user's leg are initially bent at approximately a ninety degree angle. The user applies force to the exercise device by straightening his or her legs. Movement of the exercise device is resisted by a weight stack or other resistance element. When the user's legs are in the extended position, the user reduces the force applied to the exercise device by bending the knees and allowing the exercise device to return to the starting position to complete the exercise. In leg curl exercises, the user maintains the same seated position with his or her legs in a straight, extended position. The user pushes down on the exercise device by bending the knees until the legs are bent at approximately a ninety degree angle. The user then reduces the amount of force by straightening his or her legs and slowly allows the exercise device to return to the starting position.

One drawback of existing multi-exercise machines is that the supports for the legs are not adjustable to properly support the user for all the combination of exercises. By way of example, a leg extension/leg curl machine typically includes a single leg support in a fixed position to support the user's leg during both leg curl and leg extension exercises. In prior art exercise machines, the leg support is not adjustable and remains in the same position for both exercises. During leg extension exercises, it is desirable to place the leg support close to the user's knee to keep the knee aligned with the pivot point of the exercise device during the exercise. However, when the leg support is placed close to the user's knee, it interferes with the user's leg movement during leg curl exercises. Thus, a fixed leg support does not provide optimum support for both exercises. Because of the lack of adjustment, the user is not properly supported in either exercise, which may result in injury.

Thus, there remains a need for a leg exercise machine which is easily adjustable to properly support a user through a number of separate exercises.

SUMMARY OF THE INVENTION

The present invention is directed to an exercise device having a knee alignment support that is selectively positionable allowing for support to a user's legs during a number of exercises. The selective placement of the support allows for a single machine to be used for several exercises, each of which has proper leg support for the user. The invention includes a frame structure, a seat member supported by the frame structure, and a resistance device that is overcome by the user during the exercises. A leg exercise assembly having a leg member is positioned adjacent to the seat member and connected to the resistance device. A knee alignment support is positioned adjacent to the seat support for supporting the user's legs during the exercises. The knee alignment support is movable between an inner position and an outer position for performing the various exercises.

A method of performing leg exercises is also included in the invention. The user positions the knee alignment support in a front position. The user then sits on the support member with their legs over the knee alignment support and under a leg member for performing leg extension exercises. The user then adjusts the knee alignment support to a back position, and adjusts their feet over the leg member for performing leg curl exercises.

The invention also includes an alternate pull device positioned behind the support member where the user sits allowing for additional exercises to be performed.

DETAILED DESCRIPTION OF THE PREFERRED EMBODIMENT

Figure 1:
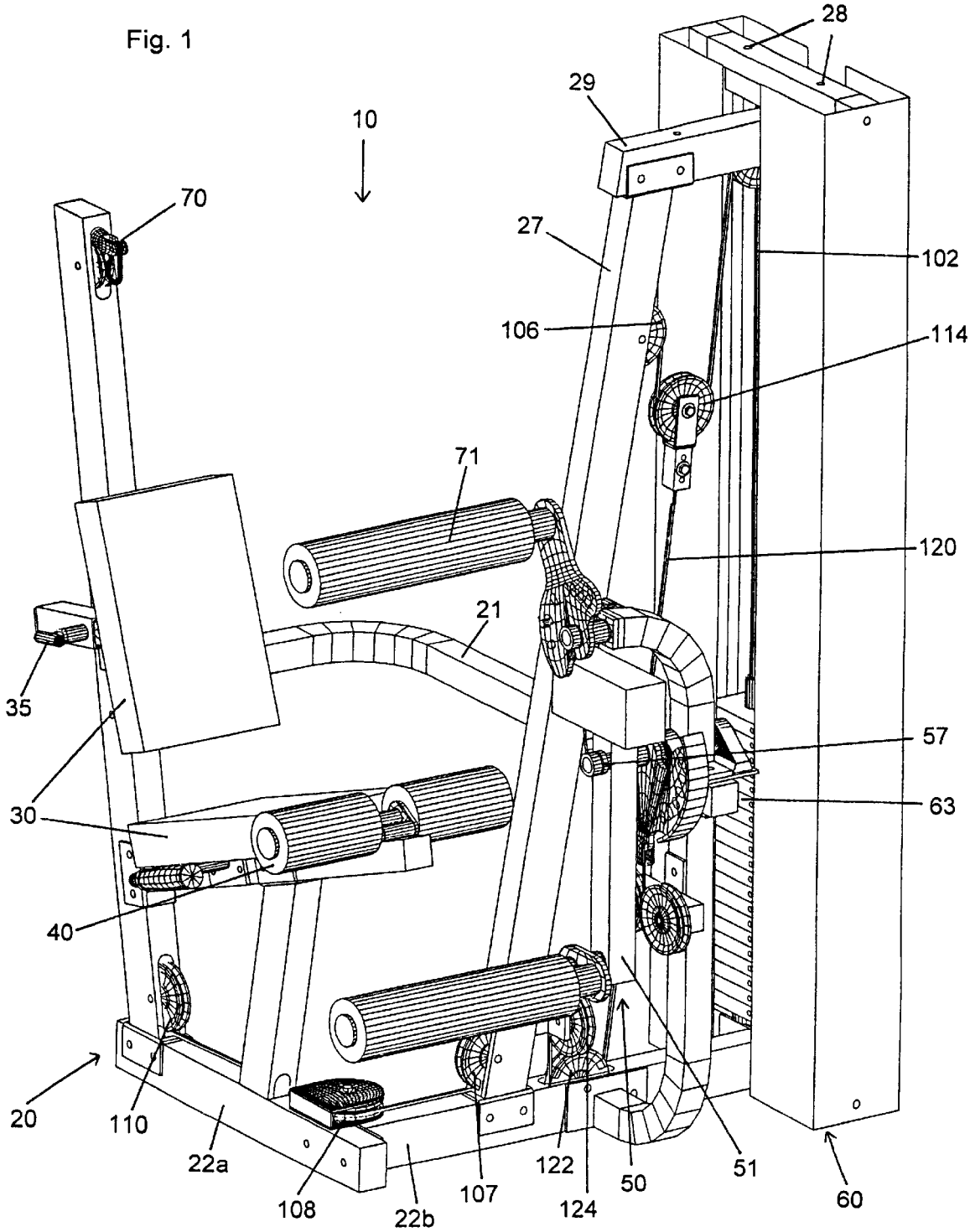
FIG. 1 is a perspective view illustrating a leg exercise machine constructed in accordance with the present invention.

Referring now to the drawings, a leg exercise machine produced in accordance with the present invention is illustrated and indicated generally by the numeral 10 in FIG. 1. The leg exercise machine 10 generally includes a frame 20 for supporting the machine, a seat 30 for positioning the user, a knee alignment support 40 for supporting the user's legs during the exercises, a leg exercise assembly 50 providing a resistance over a range of motion, and a resistance device 60 providing resistance for the exercises.

Figure 5:
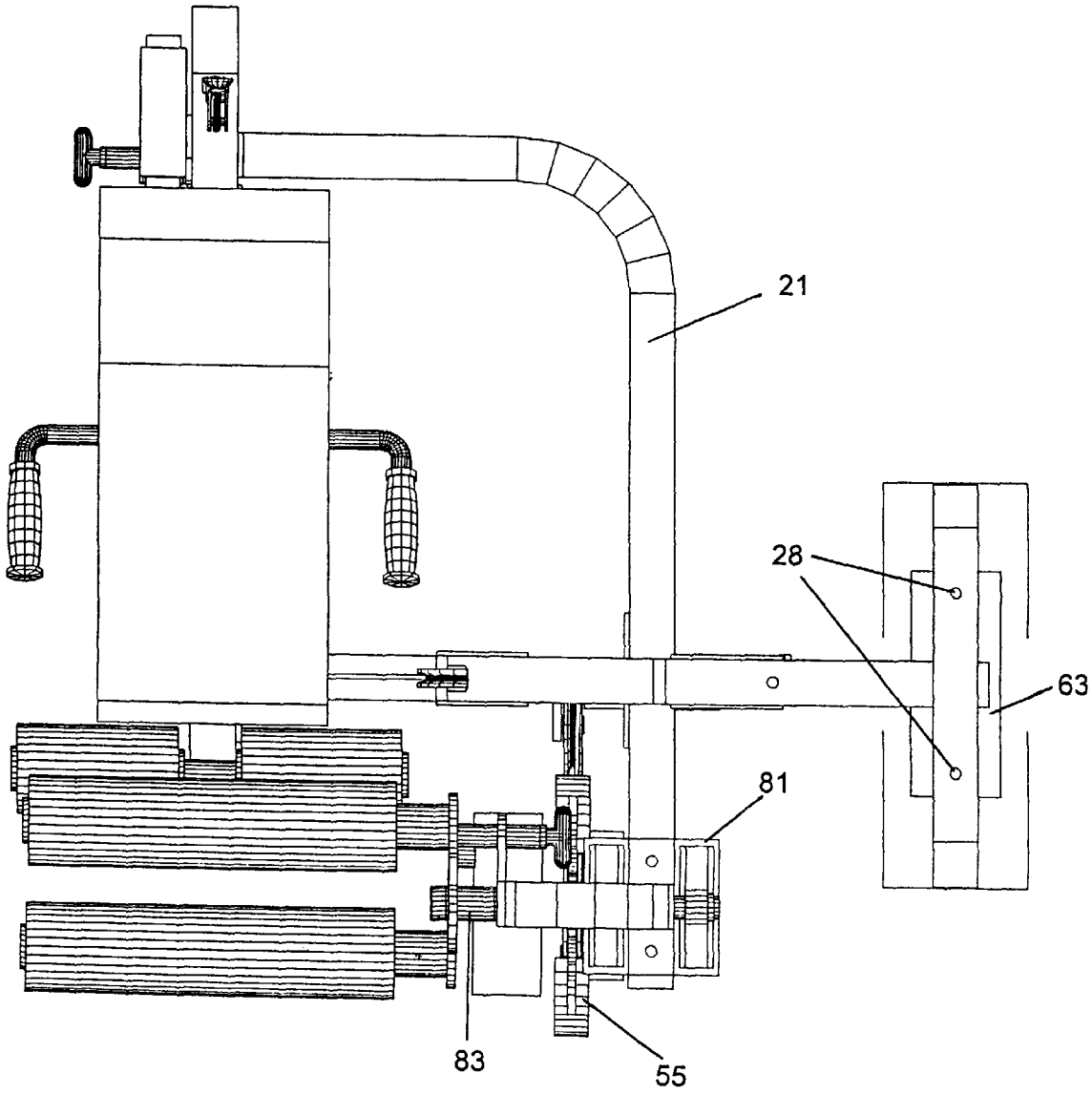
FIG. 5 is a top view of the leg exercise machine.

The frame 20 provides structural support and stability to the leg exercise machine 10. The frame 20 may have a variety of configurations depending upon the specific application. In one embodiment, the frame 20 includes a base 22 comprising base members 22*a* and 22*b* forming a foundation for the machine. A column 27 extends upwardly from the base 22 to a top member 29. Preferably, a pair of guide rods 28 extend vertically from the base 22*b* to the top member 29. The guide rods 28 guide a weight stack 63, which provides the resistance for the exercise device 10. Support member 26 extends upward from base member 22*b* and supports the leg exercise assembly 50. As best illustrated in FIGS. 1 and 5, a curved support 21 extends behind the seat 30 and connects with the support member 26.

Figure 2:
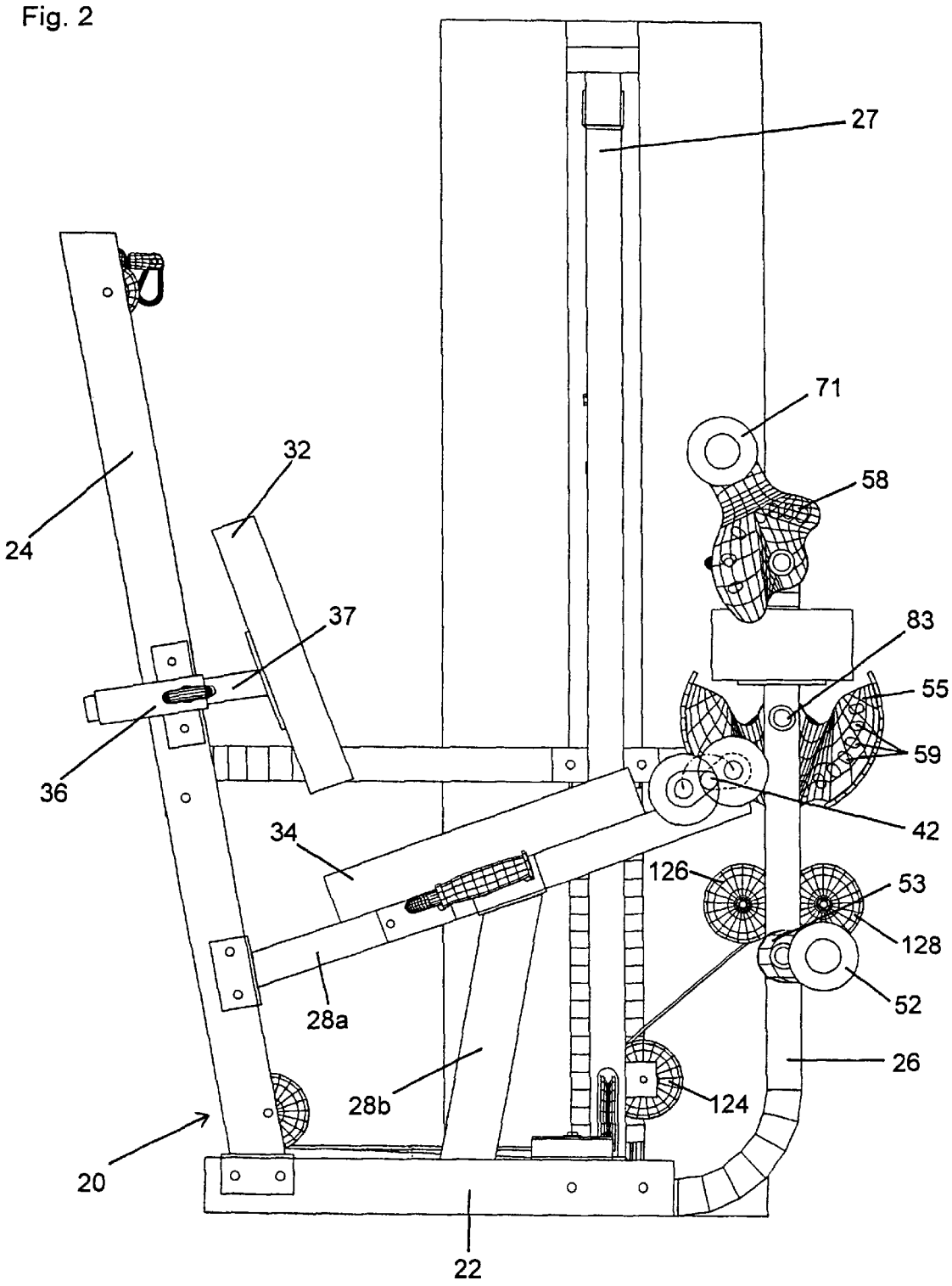
FIG. 2 is a side-view illustrating the leg exercise machine.

A back support member 24 is attached to the base member 22*a* for mounting a seat back 32. Seat support members 28*a* and 28*b* support the seat rest 34. The seat 30 includes the seat back 32 and a seat rest 34. The seat back 32 extends forward from the back support member 24 and preferably includes an adjustment device 36 for selectively positioning the seat back 32 to accommodate users of different size. In one embodiment, the adjustment device 36 includes a tube 37 having a series of openings which fits into a sleeve fixed to the back support member 24. A pin 35 extends through apertures in the sleeve and seat back support for adjusting the seat back 32. Preferably, the seat rest 34 is fixedly attached to the frame 20. Handles 39 may be positioned adjacent to the seat rest 34 for grasping by the user during the exercises. Preferably, seat rest 34 is angled at an incline as best illustrated in FIG. 2.

The leg exercise assembly 50 includes a leg member 51 that is pivotally attached to the curved member 21. A plate 81 attached to the curved member 21 supports a hinge member 83 for mounting the leg member 51 and a bidirectional cam 55. An ankle pad 52 is attached to a lower end of the leg member 51. The ankle pad 52 may be permanently fixed directly to the lower end of the leg member 51. Alternatively, the ankle pad 52 may be attached to the lower end of the leg member 51 by a movable arm 53 as shown in FIG. 2 allowing movement of the ankle pad 52 relative to the leg member 51. The ankle pad 52 is preferably constructed of a foam material providing a soft contact surface for the user's leg. The bidirectional cam 55 is attached to the hinge member 83 and includes contact surfaces for contacting the cables during the lifting process.

The cam 55 includes apertures 59 disposed inward from each contact surface for adjusting the angular displacement of the leg member 51. An extension or other like device (not shown) extends through the aperture for positioning the leg member 50. By way of example, the leg member 51 is positioned at a substantially perpendicular angle to the floor as illustrated in FIGS. 1 and 2 for performing leg extension exercises. The leg member 51 may be positioned at a variety of orientations depending upon the specific exercise to be performed and the desired range of motion.

Figure 3:
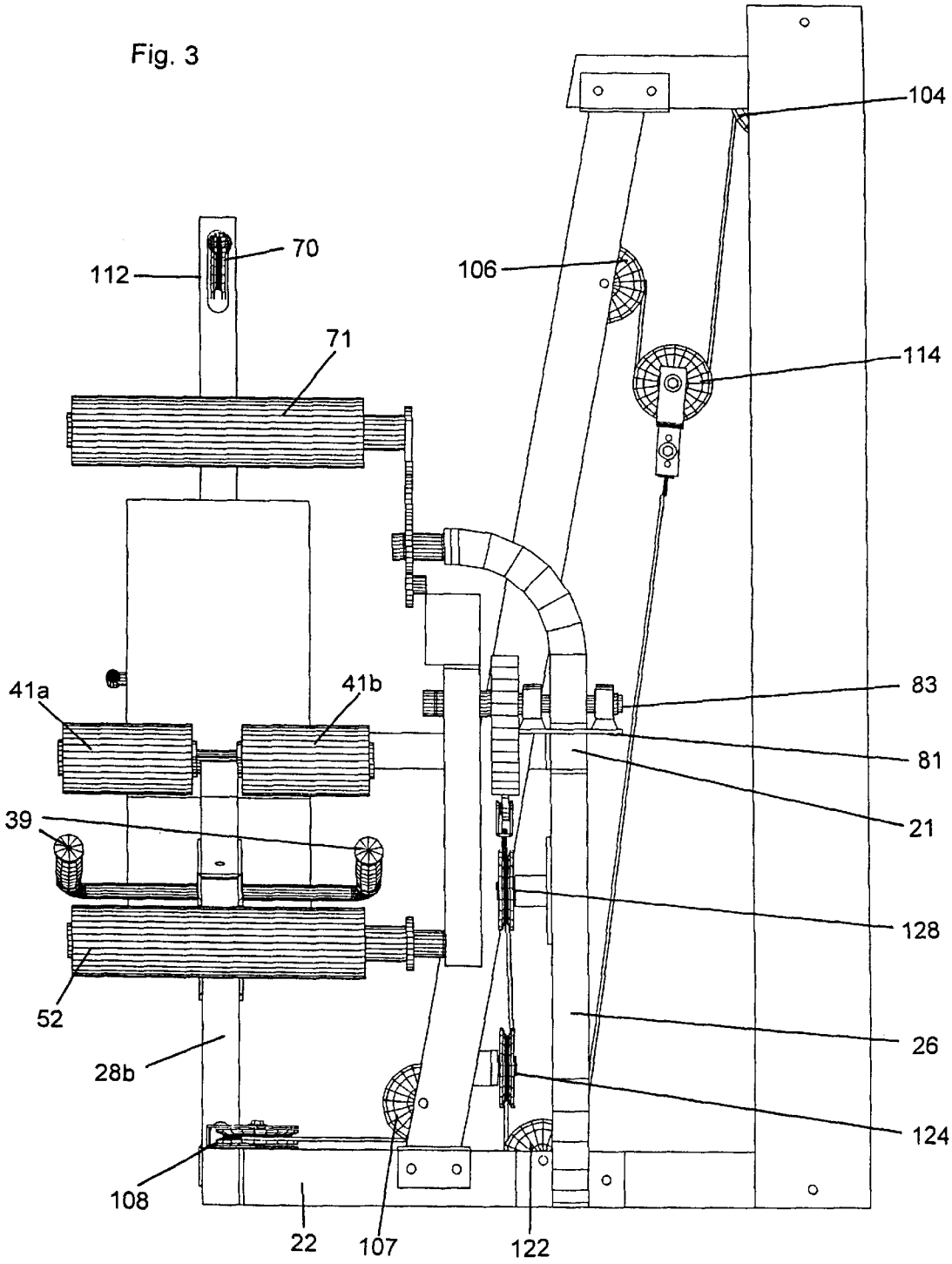
FIG. 3 is a front-view illustrating the leg exercise machine of the present invention.
Figure 4:
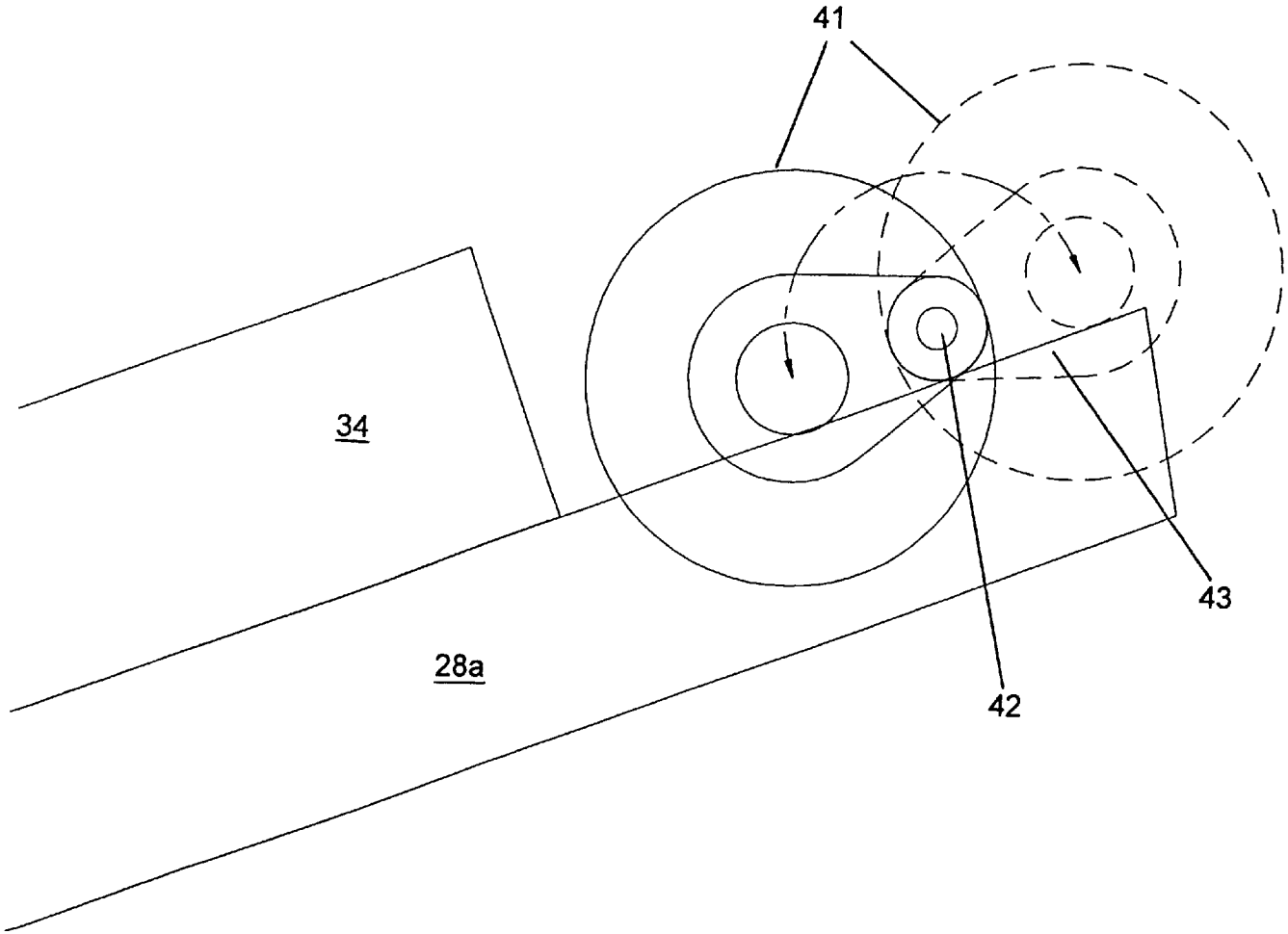
FIG. 4 is a schematic illustration of the knee alignment support selectively positionable between first and second positions.

The knee-alignment support 40 includes a leg support roller 41 pivotally attached at pivot 42 to seat support member 28*a*. As illustrated in FIGS. 1 and 3, the leg support 41 includes a first and second leg support rollers 41*a* and 41*b* attached to a swing member 43. The swing member 43 is mounted to the seat support member 28*a* in front of the seat rest 34. The leg support 41 may alternatively include a single roller for support of both legs of the user. The leg support 41 pivots between an outer position illustrated by the dashed lines in FIG. 4 for performing leg extension exercises and an inner position illustrated by the solid lines in FIG. 4 for performing leg curl exercises. The knee alignment support 40 and seat rest 34 are positioned in substantially the same plane. Preferably, the leg support 41 can be adjusted between the first and second positions while the user remains seated in the seat rest 34.

A leg hold down roller 71 is moveably attached to the curved member 21. The leg hold down roller 71 engages the user's thigh above the knee to prevent the user's leg from lifting up during leg curl exercises. The hold down roller 71 is attached to a cam 58 that permits the angular position of the hold down roller to be adjusted to suit the user. In one embodiment, the leg hold down cam 58 includes a plurality of apertures engaged by a pin to selectively adjust the angular position of the hold down roller 71.

A resistance device 60 preferably includes a weight stack 63 allowing resistance to the leg exercise assembly 50 during the exercises. In the embodiment illustrated in FIGS. 1–3, the weight stack is connected to the leg exercise assembly 50 via a cable and pulley system 100. Preferably, the weight stack 63 includes a number of individual plates which may be incrementally added allowing for increased amounts of resistance. Guide rods 28 extend through apertures in each of the plates and the weights slide to vertically along the guide rods as the user exercises. Those skilled in the art will appreciate that other resistance devices, such as electronic resistance devices or magnetic brakes, may also be used to practice the invention.

Figure 6:
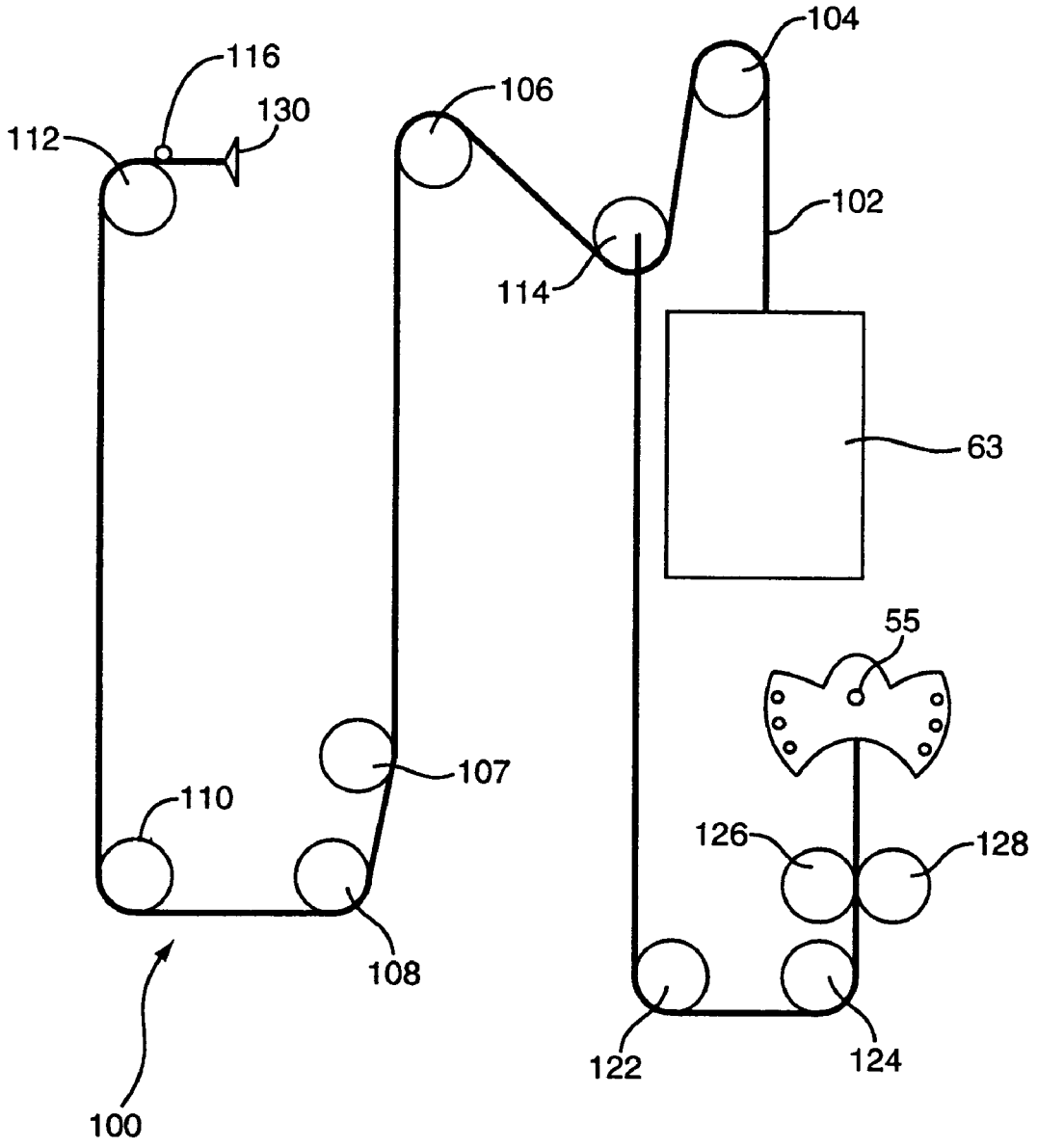
FIG. 6 is a schematic diagram of the cables and pulleys of the present invention.

The exercise assembly as previously mentioned is connected via a cable and pulley system 100 to the weight stack 63. The cable and pulley system 100 is shown schematically in FIG. 6. The cable and pulley system 100 includes a first cable 102 connected at one end to the weight stack 63. The opposite end is, in a preferred embodiment, connected to an alternate pull device 70, which in the disclosed embodiment allows for performing additional exercises including an abdominal crunch exercise and tricep extension exercise. The cable 102 passes around pulleys 104, 106, 107, 108, 110, 112, and 114. Pulleys 104, 106, 107, 108, 110, and 112 are fixed pulleys supported by the frame 20. Pulley 114 is a floating pulley. A ball stop 116 is mounted to the first cable 102. A second cable 120 is attached at one end to the floating pulley 114 and at the opposite end to the cam 55. The second cable passes around fixed pulleys 122, 124, and between fixed pulleys 126 and 128.

As the first cable is pulled, the weight stack 63 is raised. When the leg exercise assembly 50 is used, the cam 55 rotates in either a clockwise or counter-clockwise direction. The contact surfaces of the cam 55 engage the cable. As the cam rotates, the cable conforms to the contact surface of the cam 55 and is thereby pulled causing the weight stack 63 to be raised.

In use, the user positions themselves on the seat rest 34 and adjusts the seat back 32 positioning their knees to be aligned with the leg member pivot 57. To perform leg curls, the leg support rollers 41 are positioned in the in position closest to the seat member 34. The leg member 50 is adjusted at the cam 55 to extend outward away from the user. The user places their legs over the leg support rollers 41*a* and 41*b* and adjusts the leg hold down roller 51 over the top of their legs. The back of the user's lower legs are positioned over the ankle pad 52. The user pulls down on the ankle pad 52 rotating the leg member 50 about leg member pivot 57. The placement of the leg support roller 41 in the inward position allows the user to pull their legs against the ankle pad 52 beyond a position perpendicular to the floor to exercise through a full range of motion and also maintain correct knee alignment. The user then slowly allows the ankle pad 52 to pivot upward to complete the repetition.

To convert the machine for leg extensions, the leg support roller 41 is positioned to the outer position. The leg member 50 is adjusted to a position substantially perpendicular to the floor as illustrated in FIGS. 1, 2, and 3. The user's legs for this exercise are placed over the leg support rollers 41 and the front lower leg is placed behind the ankle pad 52. The user exerts force to lift the ankle pad 52 upward to a position substantially parallel with the floor. To complete the repetition, the user reduces the amount of force on the ankle pad 52 allowing it to return to the starting position.

The present invention may be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. An exercise machine comprising:

a frame structure;

a seat member supported by said frame structure;

a resistance device;

a leg exercise assembly connected to said frame structure for engagement by a user's legs when a user is positioned within said seat member, said leg exercise assembly operatively connected to said resistance device; and a knee alignment support positioned adjacent to said seat member and under a user's legs when a user is positioned within said seat member, said knee alignment support being movable between a first position for performing a first, leg curl exercise and a second position for performing a second, leg extension exercise, each of said first and second positions being aligned with said seat member such that said seat member and said knee alignment support are positioned in substantially the same plane and under a seated user's legs to support a user's legs during said first and second exercises.

2. The machine of claim 1, further including a cam mounted to said leg exercise assembly for adjusting a leg member relative to said seat member.

3. The machine of claim 1, further including a leg hold down support adjustably mounted to said frame for extending over a user's legs.

4. The machine of claim 3, further including an ankle pad rotatably connected to said leg member.

5. The machine of claim 3, wherein said resistance device includes a plurality of weights connected to said leg member via at least one pulley and a cable.

6. The machine of claim 1, further including an alternative pull device operatively connected to said resistance device and being mounted in said frame structure.

7. The machine of claim 1, wherein said knee alignment support is pivotally mounted to said frame structure.

8. A leg exercise device comprising:

a frame;

a leg member pivotally attached to said frame;

a plurality of weights connected to said leg member;

a seat member mounted on said frame; and a knee alignment support positioned adjacent to said seat member and selectively positionable between a back position for performing leg curl exercises and a front position for performing leg extension exercises, said knee alignment support being aligned with said seat member such that said seat member and said knee alignment support are positioned in substantially the same plane and under a seated user's legs in both said front and back positions to support a user's legs during leg curl and leg extension exercises.

9. The device of claim 8, wherein said frame includes a base, a back member attached to said base, and a front member attached to said base.

10. The device of claim 8, wherein at least one cable and pulley connects said plurality of weights with said leg member.

11. The device of claim 8, wherein said leg member is pivotally attached to said frame at a pivot and being adjustably positioned relative to said seat member by a bi-directional cam.

12. A method of performing leg exercises comprising the steps of:

positioning a knee alignment support in a front position;

sitting on a support member and performing leg extension exercises;

adjusting said knee alignment support to a back position;

performing leg curl exercises;

placing one's legs over the knee alignment support and feet under a leg member for performing the leg extension exercise; and placing one's legs over the knee alignment support and one's feet over the leg member for performing the leg curl exercise.

13. The method of claim 12, further including adjusting a leg member relative to the support member.

14. The method of claim 12, further including adjusting the support member for positioning one's knees relative to a pivot point on the knee alignment support.

15. The method of claim 12, further including performing arm exercises while seated in the support member using an alternate pull device.

16. An exercise machine comprising:

a frame structure:

a seat member supported by said frame structure, said seat member comprising a seat back and a seat rest;

a resistance device;

a leg exercise assembly connected to said frame structure for engagement by a user's legs when a user is positioned within said seat member, said leg exercise assembly operatively connected to said resistance device; and a knee alignment support aligned with said seat rest in substantially the same plane and being movable between a first position for performing a first, leg curl exercise and a second position farther from said seat back than said first position for performing a second, leg extension exercise, each of said first and second positions in said same plane and under a seated user's legs to support a seated user's legs during said first and second exercises.

* * * * *